US006192647B1

(12) United States Patent
Dahl

(10) Patent No.: US 6,192,647 B1
(45) Date of Patent: Feb. 27, 2001

(54) HIGH STRENGTH GROUTED PIPE COUPLER

(76) Inventor: Kjell L. Dahl, 919 Bayside Dr., Newport Beach, CA (US) 92660

( * ) Notice: Subject to any disclaimer, the term of this patent is extended or adjusted under 35 U.S.C. 154(b) by 0 days.

(21) Appl. No.: 09/292,416

(22) Filed: Apr. 15, 1999

(51) Int. Cl.[7] ..... E04C 3/30

(52) U.S. Cl. ..... 52/726.1; 52/583.1; 52/295

(58) Field of Search ..... 52/726.1, 726.2, 52/726.3, 726.4, 583.1, 566, 295, 251, 252

(56) References Cited

U.S. PATENT DOCUMENTS

| | | | | |
|---|---|---|---|---|
| 4,627,212 | * | 12/1986 | Yee | 52/726.1 |
| 5,308,184 | * | 5/1994 | Bernard | 52/726.1 X |
| 5,366,672 | * | 11/1994 | Albrigo et al. | 52/726.1 X |
| 5,383,740 | * | 1/1995 | Lancelot | 52/726.1 X |
| 5,606,839 | * | 3/1997 | Baumann | 52/726.1 |
| 5,732,525 | * | 3/1998 | Mochizuki et al. | 52/726.1 |

FOREIGN PATENT DOCUMENTS

| | | | | |
|---|---|---|---|---|
| 2034857 | * | 6/1980 | (GB) | 52/726.1 |

* cited by examiner

*Primary Examiner*—Jerry Redman
(74) *Attorney, Agent, or Firm*—Morland C. Fischer

(57) ABSTRACT

A high strength grouted pipe coupler by which pairs of spaced axially aligned steel reinforcement bars (i.e. rebars) are reliably spliced to one another for the purpose of connecting together and providing continuous support for contiguous columns, walls, beams, and similar structures to enable buildings, parking structures, bridges, subways, and airports, to be better able to survive a seismic event. The coupler includes a hollow steel pipe to receive opposing ends of the pair of reinforcement bars. A first of the reinforcement bars is upset to include a relatively wide head, and a relatively rigid spiral wire surrounds the upset head of the first reinforcement bar at the interior of the hollow pipe. The hollow pipe is filled with a cement grout which engulfs the upset head of the first reinforcement bar and the spiral wire extending therearound. The upset head and the spiral wire of the coupler cooperate to anchor the upset end of the first reinforcement bar within the cement grout and prevent the cement grout from being pulled out of the hollow pipe in response to tension and compression forces.

13 Claims, 5 Drawing Sheets

HIGH STRENGTH GROUTED PIPE COUPLER

BACKGROUND OF THE INVENTION

1. Field of the Invention

This invention relates to a high strength grouted pipe coupler by which pairs of spaced axially aligned steel reinforcement bars (i.e. rebars) are reliably spliced to one another for the purpose of connecting together and providing continuous support for contiguous precast or cast-in-place columns, walls, beams, and similar concrete structures to enable buildings, parking structures, bridges, subways, airports, and the like, to be better able to survive a seismic event.

2. Background Art

It is common in the construction industry, during the erection and retrofitting of buildings, parking structures, bridges, subways, airports, etc., to add a new contiguous concrete structure to an existing precast concrete structure. Care must be taken during construction to ensure that the contiguous structures are interconnected so that they will not shift relative to one another, particularly as a consequence of a seismic event. The foregoing has typically been accomplished by means of splicing together steel reinforcement bars (commonly known as rebars) that are embedded in and project from the existing and new structures so as to provide continuous reinforcement between the structures, whereby the structures will be capable of withstanding shear forces as well as tensile and compressive loads.

It has been known to use cement grout filled pipe couplers to splice together opposing rebar upstands that are embedded in the existing and new concrete structures. Such pipe couplers are usually made from steel by means of a casting process which increases the cost of construction, especially when large numbers of couplers are used in a project. In addition, the conventional pipe coupler requires a relatively long cylindrical pipe so as to prevent a separation of the rebars from their couplers in response to strong pulling forces.

In this same regard, the majority of stress experienced by conventional cement grout filled pipe couplers are concentrated along the interface of the reinforcement bar with the cement grout with which the cylindrical pipe of the coupler is filled. Consequently, the reinforcement bars can be undesirably loosened from or pulled out of their pipe couplers under compression and tension forces, such as those generated during an earthquake. To overcome this problem, the rebar has been provided with pronounced ribs along the length thereof to enhance the bond between the reinforcement bar and the cement core which fills the cylindrical pipe of the coupler. In other cases, a special, high strength cement grout has been used to preserve the integrity of the pipe coupler. In both of these solutions, the cost and complexity of manufacturing and/or installing known conventional grouted pipe couplers are increased which leads to an overall inefficient and possibly unreliable construction effort.

Accordingly, it would be desirable to have a relatively low cost, high strength and readily available cement grouted pipe coupler that will overcome the problems associated with conventional pipe couplers so as to be capable of reliably splicing together a pair of opposing embedded reinforcement bars and withstanding decoupling under tension and compression loads like those generated during an earthquake.

Reference may be made to the following application and patents for examples of conventional grouted pipe couplers:

European Application 92117276.3 published Jun. 23, 1993

U.S. Pat. No. 3,540,763 issued Nov. 17, 1970

U.S. Pat. No. 4,627,212 issued Dec. 9, 1986

U.S. Pat. No. 5,366,672 issued Nov. 22, 1994

SUMMARY OF THE INVENTION

In general terms, a high strength grouted pipe coupler is disclosed by which pairs of spaced, axially aligned steel reinforcement bars (i.e. rebars) are spliced to one another for connecting together contiguous precast and cast-in-place columns, walls, beams, etc. during the construction or retrofitting of a building, parking structure, bridge, subway, airport, or the like. A precast concrete structure has a first reinforcement bar embedded therewithin and projecting upwardly therefrom. The top or free end of the first reinforcement bar is first upset so as to have a relatively wide head.

Next, the pipe coupler is installed by positioning a hollow cylindrical steel pipe around the first reinforcement bar so that the cylindrical pipe rests upon a seal which lies against the concrete structure from which the bar projects. Located within the hollow cylindrical pipe is a spiral reinforcement wire that surrounds the reinforcement bar in coaxial alignment therewith. An opposing reinforcement bar having a relatively wide upset head formed thereon is coupled to the cylindrical pipe by means of threaded male and female collar and anchor members which engage the upset end of the opposing reinforcement bar. The upset heads of the first and opposing reinforcement bars are arranged in spaced axial alignment with one another at the interior of the hollow cylindrical pipe.

The interior of the hollow pipe of the pipe coupler is then filled with cement grout via a grout inlet port so as to envelop the spiral reinforcement wire therewithin. By virtue of the spiral reinforcement wire, the stresses that are applied to the first reinforcement bar during an earthquake are uniformly spread out and distributed away from the upset head thereof so as to improve the bond between the reinforcement bar and the cement core at the interior of the pipe coupler. In addition, the combination of the spiral reinforcement wire and the upset heads of the first and opposing reinforcement bars cooperate to anchor the cement core within the pipe coupler in order to impede a removal of the cement core from the coupler and prevent the first reinforcement bar from pulling loose of the core. Accordingly, continuous and reliable reinforcement between contiguous concrete structures is provided by means of the grouted pipe coupler of this invention splicing together a pair of opposing reinforcement bars that project from such structures.

DETAILED DESCRIPTION

Figure 2:
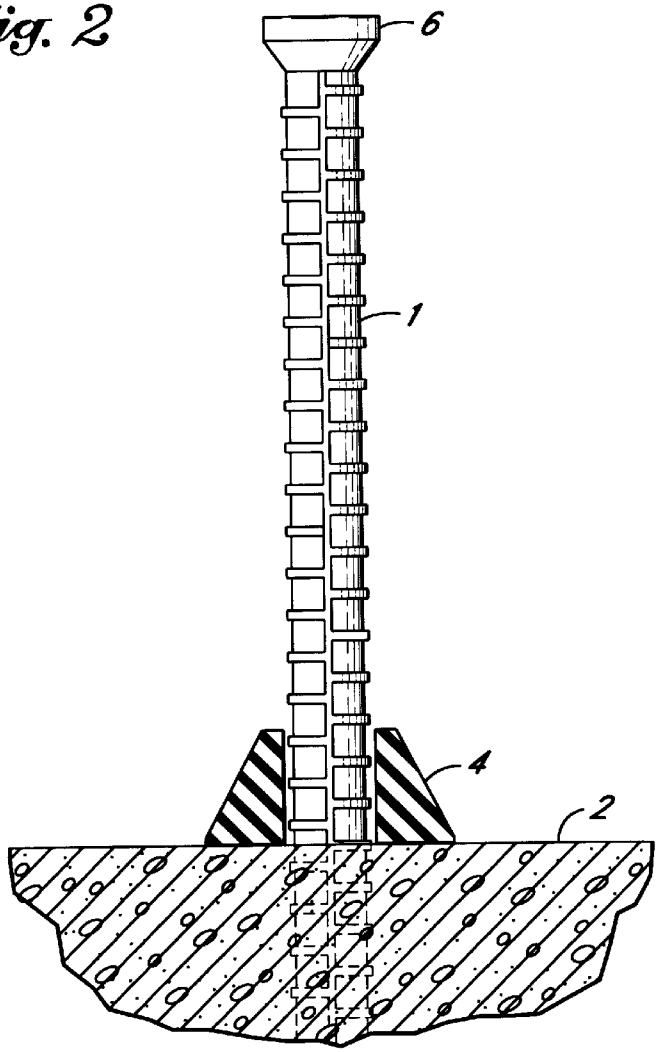
FIG. 2 shows the reinforcement bar of FIG. 1 with the embedded end thereof surrounded by a seal and the top free end upset to include a relatively wide head.
Figure 1:
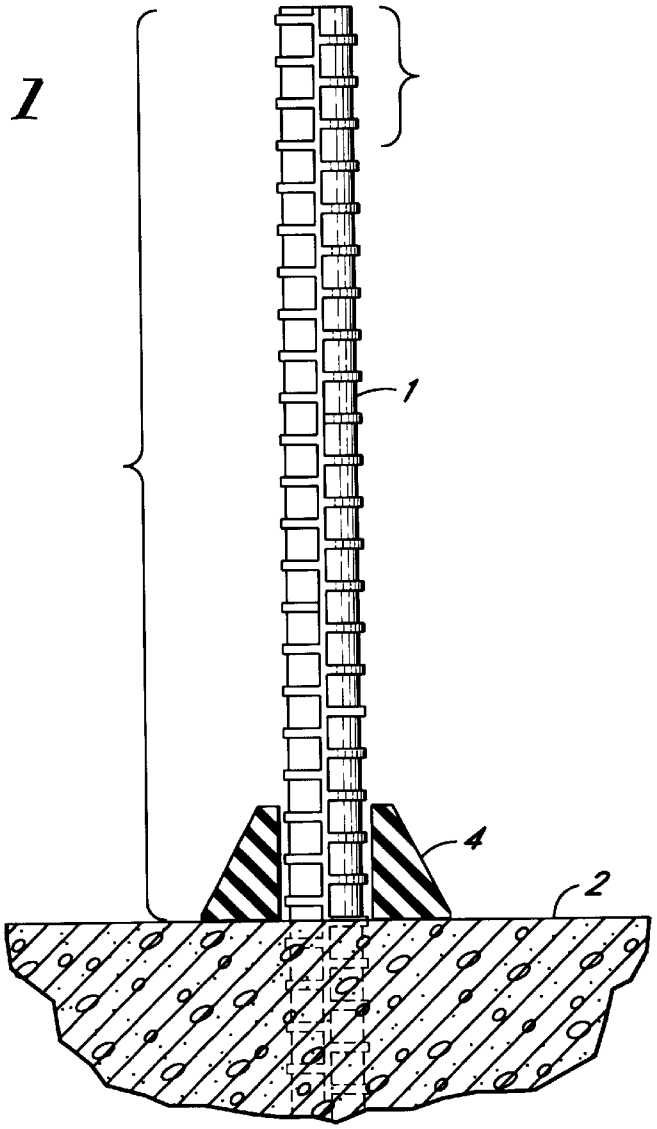
FIG. 1 shows a steel reinforcement bar embedded within and projecting from a precast concrete structure.

Details of the high strength grouted pipe coupler which forms the present invention are now described while referring to the drawings, where FIGS. 1 and 2 show a single steel reinforcement bar (i.e. commonly known as rebar) 1 embedded within and projecting upwardly from a precast concrete structure 2. By way of example, the reinforcement bar 1 in precast concrete structure 2 may experience high tension and compression loads during a seismic event. Although only a single reinforcement bar 1 is shown projecting from the concrete structure 2, it is to be understood that a plurality of such reinforcement bars would typically be embedded within and project from the structure.

Prior to installing the pipe coupler of this invention to reliably splice the reinforcement bar 1 shown in FIGS. 1 and 2 to an opposing reinforcement bar (in the manner illustrated in FIG. 3), a seal 4 is seated upon the concrete structure 2 so as to surround the bottom of reinforcement bar 1. By way of example, the seal 4 is preferably a polyethylene rubber plug. The seal 4 has a tapered configuration, the advantage of which will soon be described. As an important detail of this invention, the top or free end of the reinforcement bar 1 (opposite the end surrounded by seal 4) is upset. That is to say, the top of reinforcement 1 is provided with a relatively wide head (designated 6 in FIG. 2) having a tapered configuration. Reference may be made to commonly owned U.S. Pat. No. 5,709,121 issued Jan. 20, 1998 for an example of a method and apparatus to upset the reinforcement bar 1 so as to have the wide head 6 shown in FIG. 2.

Figure 3:
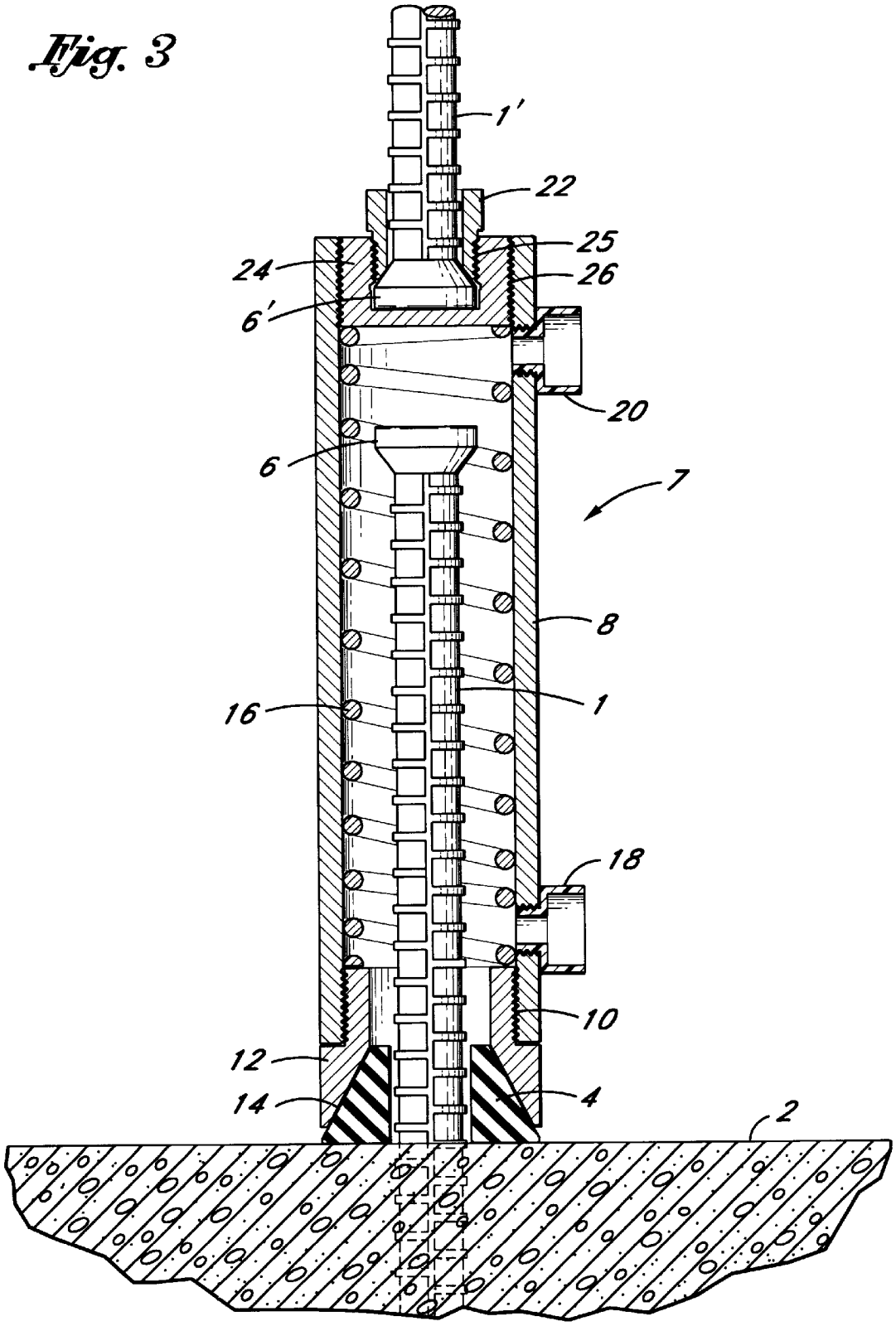
FIG. 3 shows the installation of the grouted pipe coupler of this invention adapted to splice together the reinforcement bar of FIG. 1 to an opposing reinforcement bar.
Figure 6:
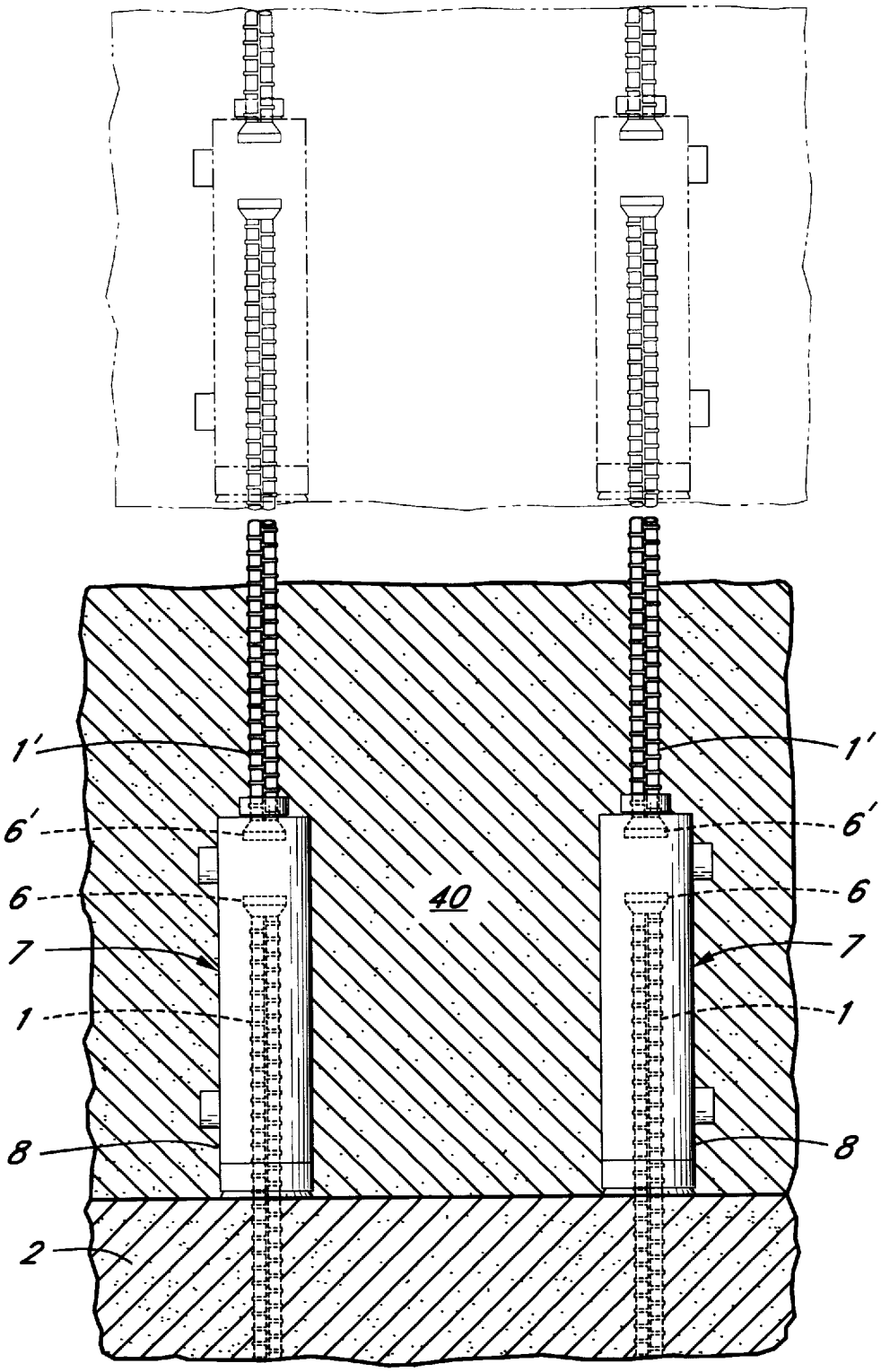
FIG. 6 shows the grouted pipe coupler splicing together a pair of axially aligned reinforcement bars that are embedded within contiguous precast concrete structures.

Turning now to FIG. 3 of the drawings, the pipe coupler 7 of this invention is installed so as to splice the reinforcement bar 1 that projects from the concrete structure 2 of FIGS. 1 and 2 to another steel reinforcement bar 1' which is embedded within a contiguous concrete structure (designated 40 in FIG. 6). In this manner, the steel reinforcement bars 1 and 1' that are spliced together by means of pipe coupler 7 will be held in spaced axial alignment with one another. Pipe coupler 7 includes a high strength (e.g. cold rolled steel) hollow cylindrical pipe 8 that is of sufficient diameter to surround the headed reinforcement bar 1 which projects from concrete structure 2. The bottom end of the hollow cylindrical pipe 8 is provided with a set of screw threads 10 that extend around the interior thereof Mated to the screw threads 10 at the bottom of the pipe 8 is a correspondingly screw threaded funnel 12. A tapered edge 14 of the funnel is adapted to fit flush against the tapered seal 4. Accordingly, the seal 4 is snugly received within the bottom end of the cylindrical pipe 8, whereby the bottom end is plugged and the pipe coupler 7 is seated upon the seal 4. By virtue of the tapered edge 14 of funnel 12, the reinforcement bar 1 will be automatically guided into coaxial alignment with the cylindrical pipe 8 in cases where the bar 1 is initially misaligned with respect to the pipe 8 as the pipe coupler 7 is moved downwardly towards the seal 4 against concrete structure 2.

Figure 5:
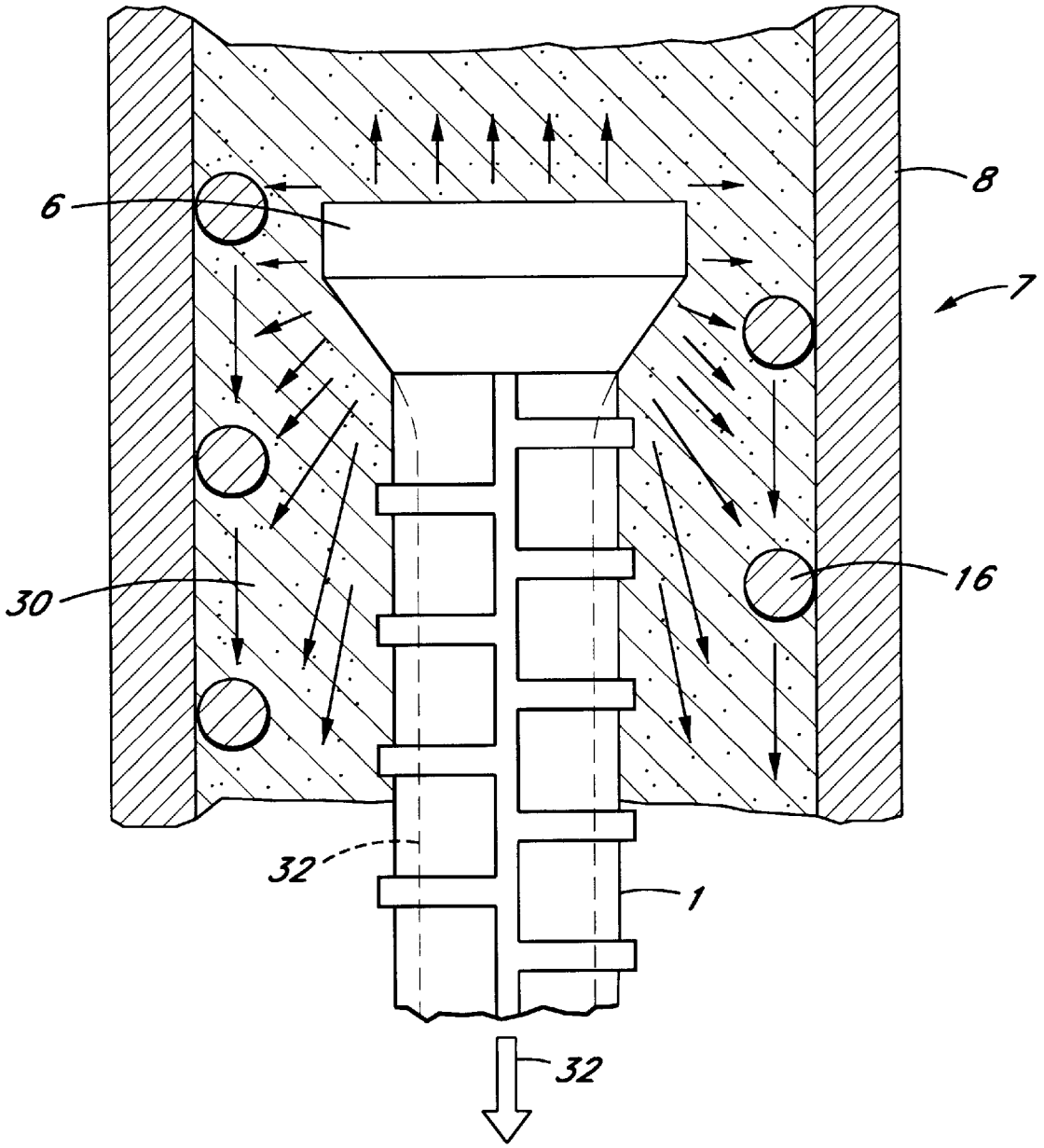
FIG. 5 illustrates the distribution of stresses away from the upset head of the reinforcement bar of FIG. 1 when pulling forces are applied to the bar during a seismic event.

Located at the interior of the hollow cylindrical pipe 8 of pipe coupler 7 is a spiral reinforcement wire 16. The spiral reinforcement wire 16 is manufactured from soft steel but has a substantially rigid configuration so as to produce suitable reinforcement for a cement core in a manner that will be described in greater detail hereinafter when referring to FIG. 5. In the assembled configuration, the spiral reinforcement wire 16 is located at the interior of the hollow cylindrical pipe 8 of coupler 7 in coaxial surrounding alignment with reinforcement bar 1 so as to be seated upon the funnel 12 that is mated to the bottom of pipe 8. Although the reinforcement wire 16 may engage the side of cylindrical pipe 8 at the interior thereof, reinforcement wire 16 is loosely held within the pipe coupler 7 and is not affixed to or restrained by the pipe 8.

In order to fill the pipe coupler 7 with a cement core at the interior of the hollow cylindrical pipe 8 (in a manner that will be described in greater detail when referring to FIG. 4), the pipe 8 is provided with threaded holes to receive a correspondingly threaded grout inlet port 18 and an air outlet port 20. It is desirable that the grout inlet port 18 and the air outlet port 20 e spaced axially from one another with air outlet port 20 located above grout inlet port 18.

After the pipe coupler 7 has been installed around the steel reinforcement bar 1 that projects upwardly from the concrete structure 2 in the manner described above, the opposing steel reinforcement bar 1' that is to be spliced to reinforcement bar 1 in spaced axial alignment therewith is coupled to the cylindrical pipe 8. To accomplish the foregoing, the free end of reinforcement bar 1' is first upset (i.e. provided with a relatively wide head 6') in the same manner used to form the upset head 6 on reinforcement bar 1.

Next, a cylindrical male collar 22 having an outside threaded surface 25 is moved axially along the reinforcement bar 1' so as to be seated upon the upset head 6' thereof To affix male collar 22 to the pipe coupler 7, a female anchor 24 having both inside and outside threaded surfaces is attached to the top end of pipe 8. Like the set of screw threads 10 at the bottom end of pipe 8, a set of screw threads 26 is also formed at the top end of pipe 8 so as to extend around the interior thereof The anchor 24 is mated to the top end of pipe 8 at the respective screw threaded surfaces thereof. In this same regard, the threaded male collar 22 which surrounds reinforcement bar 1' is mated to the female anchor 24 at the respective threaded surfaces thereof, whereby to hold the upset heads 6 and 6' of reinforcement bars 1 and 1' in spaced opposing alignment with one another.

Figure 4:
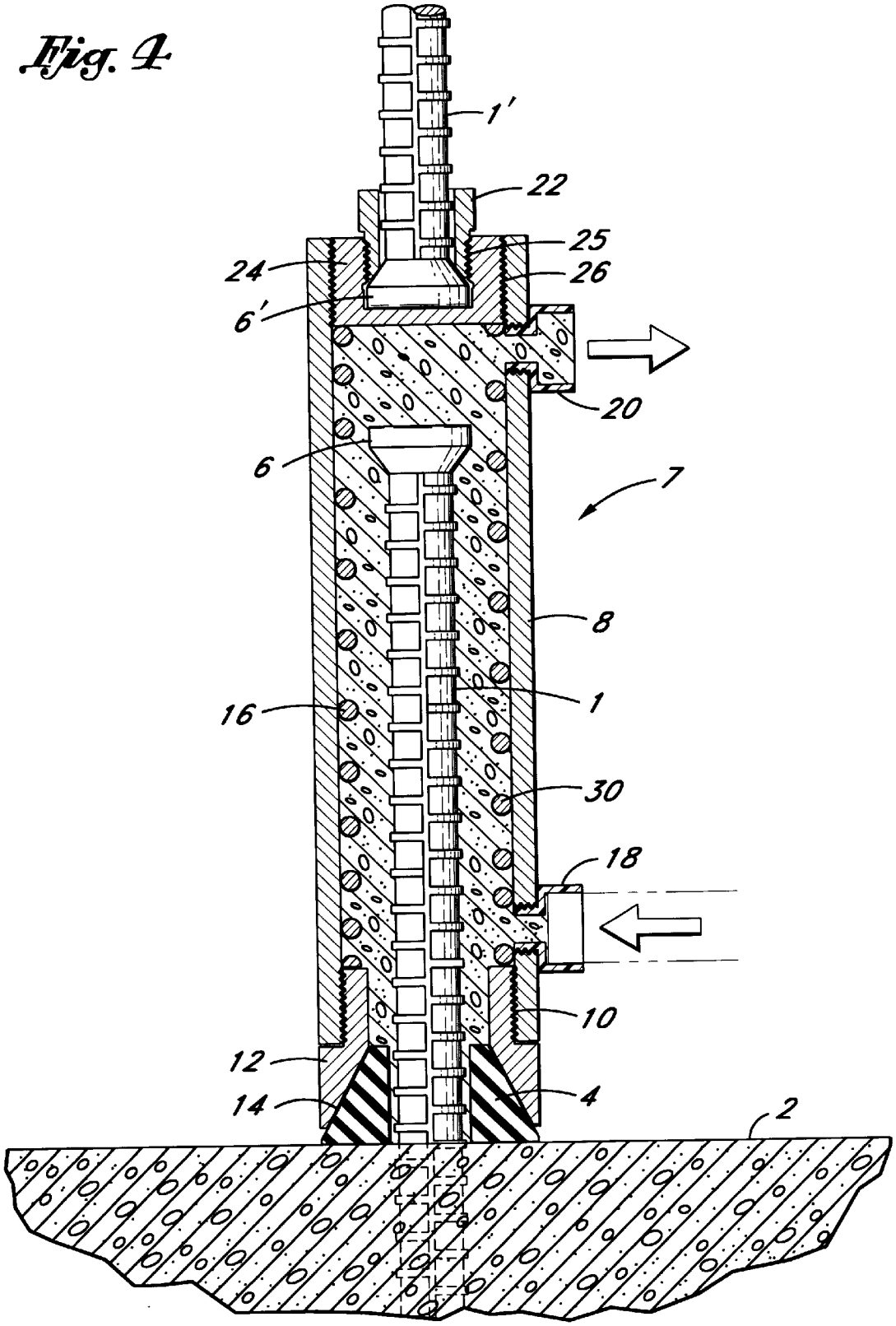
FIG. 4 shows the grouted pipe coupler of FIG. 3 filled with a cement grout core.

FIG. 4 of the drawings shows the spaced, axially aligned bars 1 and 1' spliced together by pipe coupler 7 with the interior of the hollow cylindrical pipe 8 of coupler 7 filled with a cement grout core. That is, a commercially available cement grout 30 is pumped, under pressure, into the hollow cylindrical pipe 8 via grout inlet port 18 so as to envelop the spiral reinforcement wire 16. As the grout 30 fills the closed interior of pipe 8, the air trapped at the upper end of the pipe 8 as well as any excess grout 30 will be expelled via air outlet port 20.

Referring to FIG. 6 of the drawings, in response to a seismic event (i.e. an earthquake), a pulling force (represented by the reference arrow 32) will be applied to the reinforcement bar I through the concrete structure 2 in which the bar is embedded. By virtue of the spiral reinforcement wire 16 that is seated upon the funnel 12 (shown in FIG. 4) and embedded in the concrete grout 30 within the cylindrical pipe 8 of pipe coupler 7, the stresses that are applied to reinforcement bar 1 are uniformly spread out and distributed away from the upset head 6 of the bar. What is more, the combination of the spiral reinforcement wire 16 and the upset head 6 of bar 1 cooperate to anchor the concrete grout 30 within the confines of the cylindrical pipe 8 of pipe coupler 7 so as to prevent the removal of the cement core from the pipe 8 in response to the tension and compression forces being applied to reinforcement bar 1. In addition, the upset head 6 prevents the reinforcement bar 1 from being easily pulled out of the concrete grout 30 during the application of seismic loads when the bar may be stretched and narrowed (illustrated by the phantom lines 32 of FIG. 5) and its bond loosened with the cement core inside the pipe 8.

Accordingly, the pipe coupler 7 of this invention which includes the spiral reinforcement wire 16 avoids a concentration of stress along the interface between the cement grout 30 and the reinforcement bar 1 so as to enhance the bond between the grout 30 and the bar 1 and thereby eliminate the need for a high cost, high strength cement that is specially designed to withstand large loads. Moreover, the cooperation between the upset head 6 of reinforcement bar 1 and the spiral reinforcement wire 16 enables the length of the cylindrical steel pipe 8 of pipe coupler 7 to be minimized relative to conventional couplers. By way of example, the length of cylindrical pipe 8 can be reduced to a size of no more than approximately ten diameters of the reinforcement bar 1 without sacrificing the strength of the coupler (i.e. the coupler 7 develops a load capacity substantially equal to that of the reinforcement bar 1). Of course, the coupler 7 of this invention could be designed to break under a predetermined seismic load in order to meet the requirements of uniform building codes.

FIG. 6 of the drawings illustrates a plurality of the pipe couplers 7 of this invention for splicing together pairs of spaced, axially aligned reinforcement bars 1 and 1' having opposing upset heads 6 and 6' so that the precast concrete structure 2 of FIGS. 1–4 can be reliably affixed to a contiguous precast concrete structure 40 that is laid over structure 2 to engulf the plurality of pipe couplers 7. In this way, and as is represented by phantom lines in FIG. 6, successive columns, walls, beams, and similar structures can be erected using existing precast as well as cast-in-place technology for constructing buildings, parking structures, bridges, subways, airports, and the like, with the ability to better survive a seismic event.

I claim:

1. In combination:

first and second reinforcement bars having first ends to be spaced from one another and second ends to be embedded within respective structures to be connected to one another; and a coupler to splice said first and second reinforcement bars together, said coupler having a hollow body in which the first ends of said first and second reinforcement bars are received, core reinforcement means located within said hollow body, and a cement core within said hollow body to engulf said core reinforcement means and the first end of said first reinforcement bar, said core reinforcement means comprising a spiral wire that extends longitudinally through the hollow body of said coupler in coaxial alignment with the first end of said first reinforcement bar for anchoring the first end of said first reinforcement bar within said cement core and preventing said cement core from being pulled out of said hollow body.

2. The combination recited in claim 1, wherein the hollow body of said coupler is a steel pipe.

3. The combination recited in claim 1, wherein the first end of said first reinforcement bar is upset so as to have a relatively wide head to prevent said first end from being pulled out of said cement core.

4. The combination recited in claim 1, wherein the first end of each of said first and second reinforcement bars is upset so as to have a relatively wide head.

5. The combination recited in claim 4, wherein said coupler also includes a female collar surrounding the first end of said second reinforcement bar and engaging said upset head thereof, and a male anchor connected between the hollow body of said coupler and said female collar whereby to connect the first end of said second reinforcement bar to said hollow body.

6. The combination recited in claim 1, wherein said core reinforcement means surrounds the first end of said first reinforcement bar within the hollow body of said coupler.

7. The combination recited in claim 1, wherein the hollow body of said coupler has an open top and an open bottom, said coupler also having a funnel mated to the open bottom of said hollow body to surround the first end of said first reinforcement bar and guide the first end of said first reinforcement bar into axial alignment with the longitudinal axis of said hollow body, said spiral wire being seated upon said funnel.

8. The combination recited in claim 7, wherein said coupler also includes an end plug seated against said funnel in surrounding engagement with the first end of said first reinforcement bar to seal the open bottom of the hollow body of said coupler.

9. The combination recited in claim 7, wherein said coupler also includes an end closure in surrounding engagement with the first end of said second reinforcement bar and connected to the open top of the hollow body of said coupler, said end closure mating the first end of said second reinforcement bar to said hollow body to seal the open top thereof and hold said second reinforcement in spaced axial alignment with said first reinforcement bar.

10. In combination:

first and second reinforcement bars having first ends to be spaced from one another and second ends to be embedded within respective structures to be connected together, the first end of said first reinforcement bar being upset so as to have a relatively wide head; and a coupler to splice said first and second reinforcement bars together, said coupler having a hollow pipe in which the first ends of said first and second reinforcement bars are received, a spiral wire surrounding the upset first end of said first reinforcement bar inside said hollow pipe, and a cement core located within said hollow pipe to engulf the upset first end of said first reinforcement bar and said spiral wire extending therearound, the upset first end of said first reinforcement bar and said spiral wire cooperating to anchor the first end of said first reinforcement bar within said cement core and prevent said cement core from being pulled out of said hollow pipe.

11. The combination recited in claim 10, wherein the first end of said second reinforcement bar is upset so as to have a relatively wide head, said coupler also having a female collar surrounding the first end of said second reinforcement bar and engaging said upset head thereof and a male anchor connected between said hollow pipe and said female collar whereby to connect the first end of said second reinforcement bar to said hollow pipe.

12. In combination:

first and second reinforcement bars having first ends to be spaced from one another and second ends to be embedded within respective structures to be connected to one another; each of the first ends of said first and second reinforcement bars being upset so as to have a relatively wide head;

a coupler to splice said first and second reinforcement bars together, said coupler having a hollow body in which the first ends of said first and second reinforcement bars are received, a core reinforcement located within said hollow body, a cement core located within said hollow body to engulf said core reinforcement and the first end of said first reinforcement bar, a female collar surrounding the first end of said second reinforcement bar and engaging said upset head thereof, and a male anchor connected between said hollow body and said female collar whereby to connect the first end of said second reinforcement bar to said hollow body, said core reinforcement anchoring the first end of said first reinforcement bar within said cement core and preventing said cement core from being pulled out of said hollow body.

13. The combination recited in claim 12, wherein said core reinforcement is a spiral wire that extends longitudinally through the hollow body of said coupler in coaxial alignment with the first end of said first reinforcement bar.

* * * * *